US007562402B1

(12) United States Patent
Calloway et al.

(10) Patent No.: US 7,562,402 B1
(45) Date of Patent: Jul. 21, 2009

(54) BATHTUB HAIR WASH RECLINER FOR TODDLER

(76) Inventors: Dorsie L. Calloway, 6135 Balbo St., Houston, TX (US) 77091-3705; Bruce Campbell, 6135 Balbo St., Houston, TX (US) 77091-3705

( * ) Notice: Subject to any disclaimer, the term of this patent is extended or adjusted under 35 U.S.C. 154(b) by 7 days.

(21) Appl. No.: 12/031,091

(22) Filed: Feb. 14, 2008

(51) Int. Cl.
*A47K 3/024* (2006.01)
*A47B 13/00* (2006.01)
*A47C 16/00* (2006.01)

(52) U.S. Cl. ..... 4/572.1; 5/606; 5/655

(58) Field of Classification Search ..... 5/606, 5/655, 603, 610, 620; 4/572.1, 573.1, 571.1, 4/575.1, 578.1, 659, 586; 297/16.1, 19, 354.12, 297/354.13, 364, 378.1, 423.1, 423.2
See application file for complete search history.

(56) References Cited

U.S. PATENT DOCUMENTS

D197,843 S 3/1964 Shelzi
3,579,659 A * 5/1971 Baumann ..... 261/30
4,295,683 A 10/1981 Dubbink et al.
4,338,691 A 7/1982 Gaffney
4,939,799 A 7/1990 Van Hovel
5,940,900 A * 8/1999 Wells ..... 4/515
5,970,532 A * 10/1999 Modica ..... 4/523
6,219,866 B1 * 4/2001 Pascal ..... 5/655
6,312,054 B1 11/2001 Scheurer et al.
6,318,804 B1 * 11/2001 Brown ..... 297/354.13
6,527,343 B2 3/2003 Scheurer et al.
2002/0020015 A1 * 2/2002 Rossman et al. ..... 4/572.1
2009/0025138 A1 * 1/2009 Steggert ..... 4/577.1

* cited by examiner

*Primary Examiner*—Peter M Cuomo
*Assistant Examiner*—Brittany M Wilson

(57) ABSTRACT

This patent discloses a reclining hair wash chair for a toddler in a bathtub. The bathtub hair wash recliner may include a torso support connected between a head support and a footrest. The torso support, the head support, and the foot may be hollow and have rubber strands attached to their top to provide a slip resistant surface. A bubble foam core may be positioned within the head support, the torso support, and the footrest. When the head support is lying on the torso support, the bubble foam core may be removed from the recliner by pulling on a bubble foam core tilting area in a direction that is parallel to the head support and the torso support.

13 Claims, 4 Drawing Sheets

BATHTUB HAIR WASH RECLINER FOR TODDLER

BACKGROUND

1. Field

The information disclosed in this patent relates to an accessory for the bathtub to provide support for a toddler when bathing and having his/her hair washed by another. In particular, the accessory may include a reclining hair wash chair for the toddler.

2. Background Information

Parents all over the country spend time helping their children take baths. One of the more difficult parts is washing the child's hair. The parent typically steadies the child with one hand and uses the other to rub shampoo in the child's hair. Children will attempt to shield their eyes and face from lather and water. Despite this, shampoo and water often get into the child's eyes. Other times, it is difficult to support the child above the bath water while washing their hair. As a result, many children dread having their parents wash their hair because they do not feel completely supported above the bath water and they fear getting shampoo and water in their eyes and ears. What is needed is a device to make the hair washing process easier and less traumatic for both the parent and the child.

SUMMARY

This patent discloses a reclining hair wash chair for a toddler in a bathtub. The bathtub hair wash recliner may include a torso support connected between a head support and a footrest. The torso support, the head support, and the foot may be hollow and have rubber strands attached to their top to provide a slip resistant surface. A bubble foam core may be positioned within the head support, the torso support, and the footrest. When the head support is lying on the torso support, the bubble foam core may be removed from the recliner by pulling on a bubble foam core tilting area in a direction that is parallel to the head support and the torso support.

DETAILED DESCRIPTION

Figure 1:
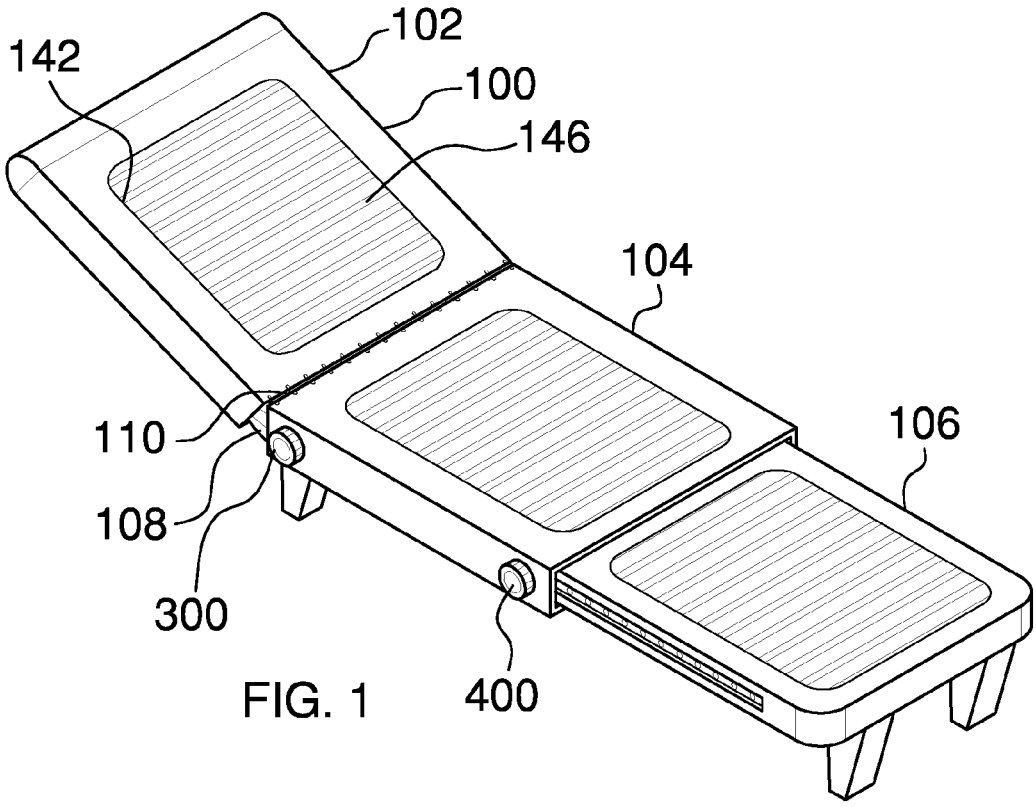
FIG. 1 is an isometric view of a recliner 100.

FIG. 1 is an isometric view of a recliner 100. Recliner 100 may be an accessory for the bathtub to provide support for a toddler when bathing and having his/her hair washed by another. Recliner 100 may be a bathtub hair wash recliner for young children at the age of learning to walk, such ages of 12 to 36 months old.

Figure 2:
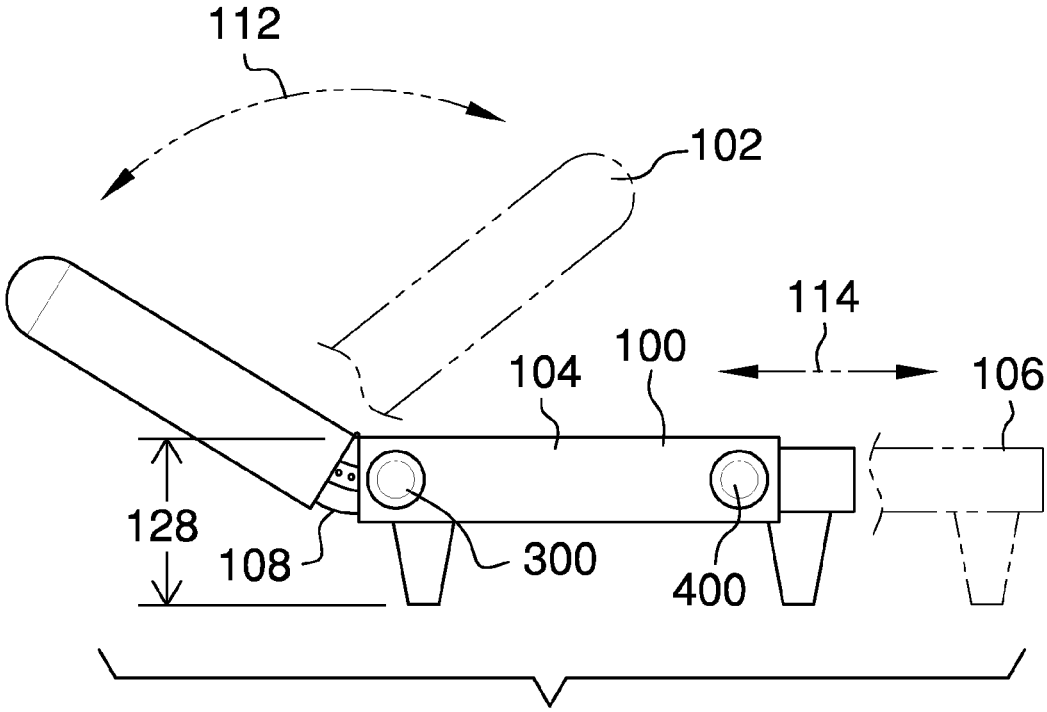
FIG. 2 is a side view of recliner 100 illustrating movement of recliner 100.

FIG. 2 is a side view of recliner 100 illustrating movement of recliner 100. Recliner 100 may include a head support 102, a torso support 104, a footrest 106, a bubble foam core 108, and a hinge 110. Hinge 110 may connect torso support 104 to head support 102 and torso support 104 may be positioned between head support 102 to footrest 106. Bubble foam core 108 may be positioned within head support 102, torso support 104, and footrest 106. Head support 102 may be tilted back and forth relative to torso support 104 in a direction of head support arrow 112. Footrest 106 may be extended into and out of torso support 104 in a direction of footrest arrow 114.

Figure 3:
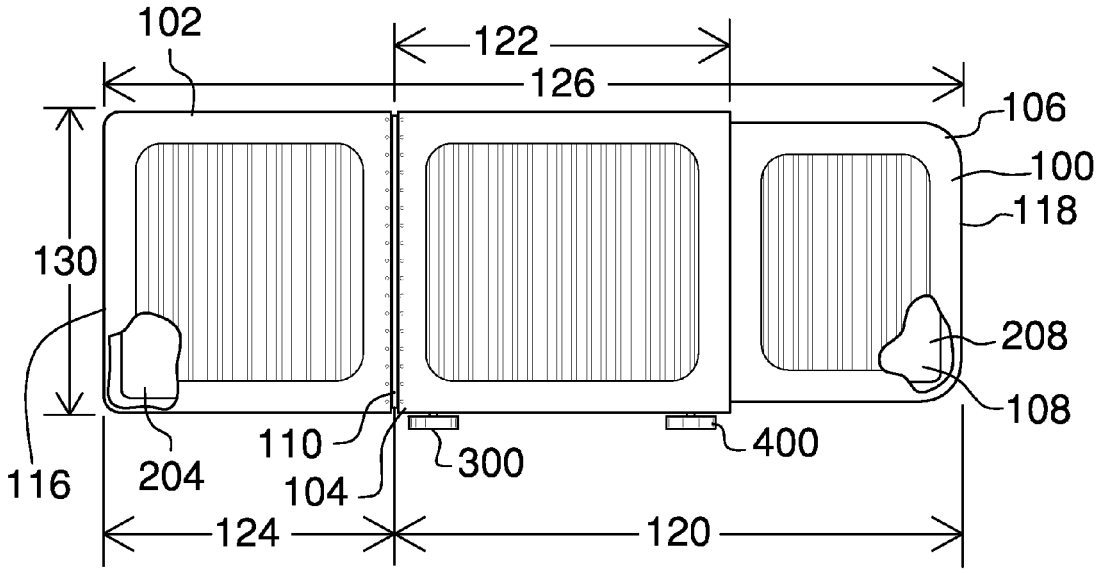
FIG. 3 is a top view of recliner 100 in a fully open position.

FIG. 3 is a top view of recliner 100 in a fully open position. Recliner 100 may have recliner rear 116 at a perimeter of head support 102 and a recliner front 118 at a perimeter of footrest 106. Recliner 100 may be positioned lengthwise between recliner rear 116 and recliner front 118 in the fully open position.

The cervicale height of toddlers and babies may be measured from the tip of the spine of the seventh cervical vertebra at the base of the neck (the cervicale) to the bottom of a reclining toddler's foot. When lying upon recliner 100, the toddler's seventh cervical vertebra should align with hinge 110 so that head support 102 may support the toddler from the neck up and torso support 104 and footrest 106 may support the toddler from the neck down. Footrest 106 may extend from torso support 104 to a maximum distance to identify a cervicale length 120 as measured between hinge 110 and recliner front 118. In one example, cervicale length 120 may be 110% of the cervicale height of a toddler in the 95th percentile.

Torso support 104 may have a torso support length 122 as measured lengthwise from hinge 110 to an opposite side of torso support 104. A buttock to cervicale distance of toddlers and babies may be the distance between the maximum posterior protrusion of the toddler's buttock to the seventh cervical vertebra at the base of the neck. In one example, torso support length 122 may be 110% of the buttock to cervicale distance of a toddler in the 95th percentile.

Head support 102 may have a head support length 124 as measured lengthwise from hinge 110 to recliner rear 116. In one example, head support length 124 approximately may be eight inches. With head support 102 tilted to be parallel with torso support 104 and footrest 106 fully extended so that recliner 100 is in a fully open position, recliner 100 may have a fully extended recliner overall length 126 and a recliner height 128 (FIG. 2). In one example, fully extended recliner overall length 126 approximately may be two feet, eight inches and recliner height 128 approximately may be eight inches.

Head support 102 and torso support 104 both may have a support width 130 (FIG. 3) as measured across head support 102 from one perimeter side to an opposite perimeter side. The shoulder (bidetoid) breadth of toddlers and babies may be the horizontal distance across the upper arms between the maximum bulges of the deltoid muscles with the arms hanging and relaxed. Support width 130 may be less than the shoulder breadth of a toddler in the 5th percentile. This may let the toddler dangle their arms down over the sides of the recliner as they lie in the recliner. In turn, the weight of the toddler's dangling arms may help keep the toddler more still. In one example, support width 130 approximately may be one foot.

Figure 4:
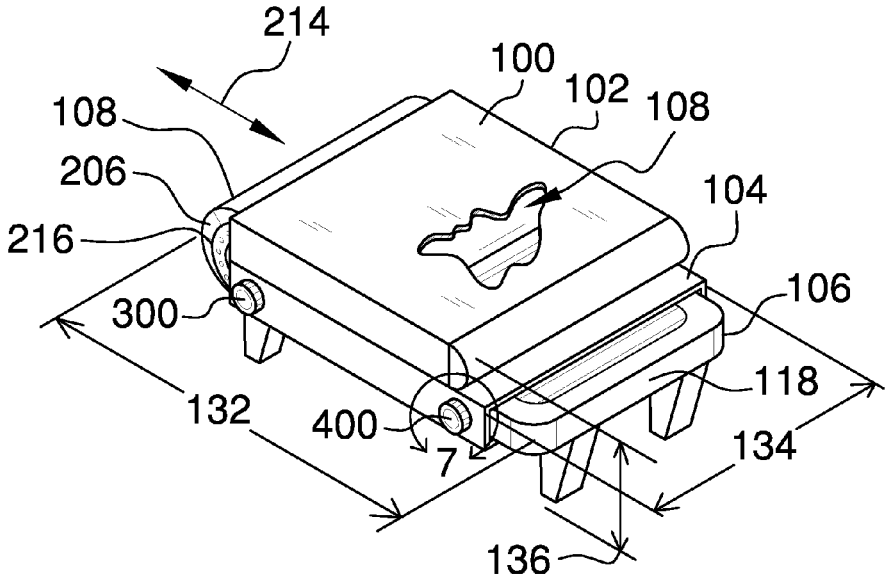
FIG. 4 is an isometric top view of recliner 100 in a fully closed position.

FIG. 4 is an isometric top view of recliner 100 in a fully closed position. In this position, recliner 100 may have a fully closed recliner overall length 132, a fully closed recliner overall width 134, and a fully closed recliner overall height 136. Fully closed recliner overall length 132 may be measured between bubble foam core 108 and recliner front 118. In one example, recliner 100 may fit within a one and one-half foot length by one foot width by one-foot high volume. The compact nature of recliner 100 may aid parents and others in transporting recliner 100 while traveling with children.

Figure 5:
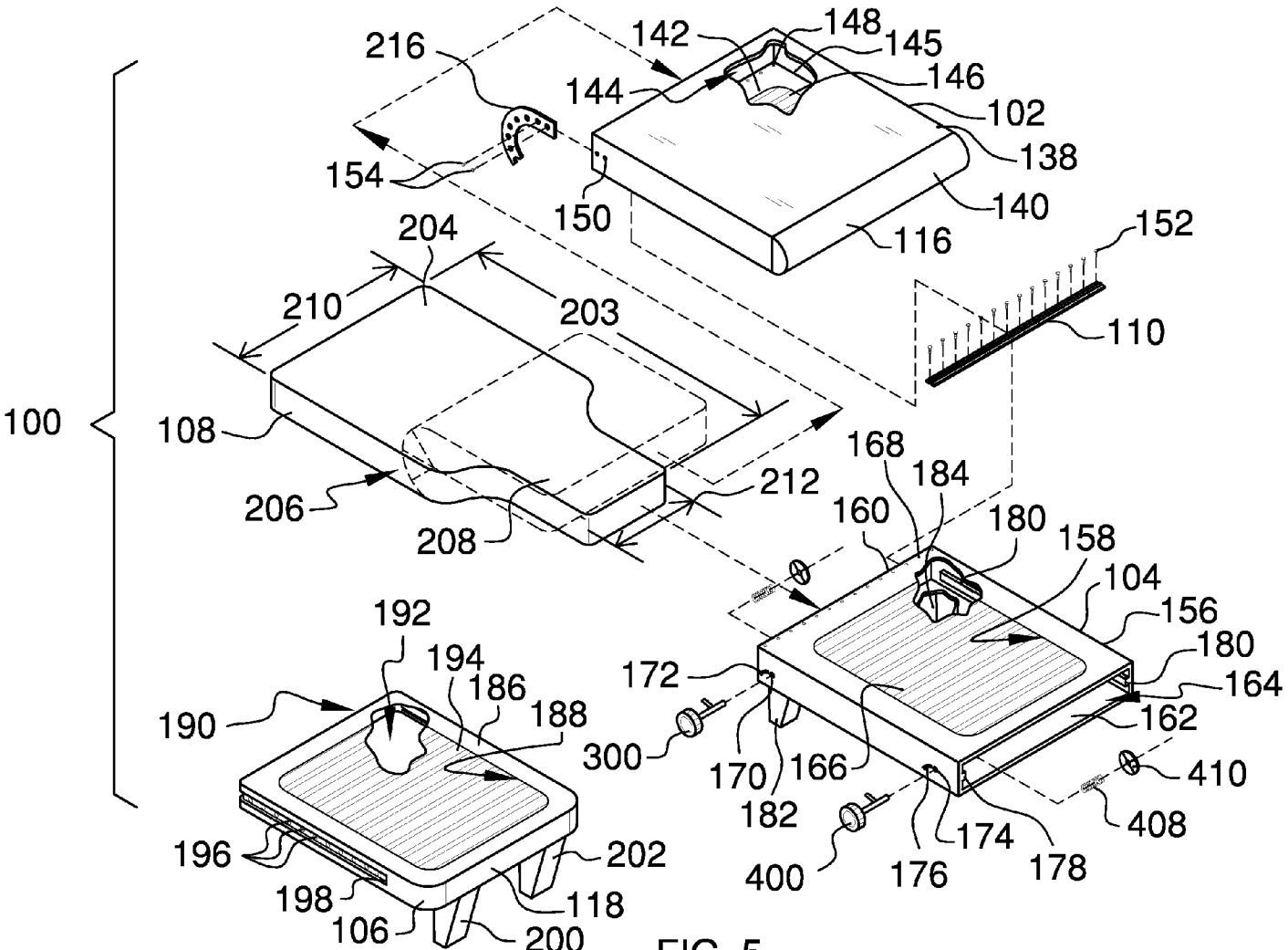
FIG. 5 is an isometric exploded view of recliner 100.

FIG. 5 is an isometric exploded view of recliner 100. As noted above, recliner 100 may include head support 102, torso support 104, footrest 106, bubble foam core 108, and hinge 110. Each component may be assembled together to form recliner 100.

Head support 102 may be a structure to bear the weight of a toddler's head. Head support 102 generally may have a rectangular shape and may include a head support frame 138 having a curved edge 140, a head support strand opening 142, a head support core opening 144, and a head support interior 145. Head support frame 138 may be hollow to define head support interior 145. Head support strand opening 142 and head support core opening 144 may be passageways through head support frame 138 into head support interior 145. Curved edge 140 may cap head support frame 138 and include recliner rear 116. Head support core opening 144 may be on an opposite side of curved edge 140 and be large enough to receive bubble foam core 108 through head support core opening 144.

Head support 102 additionally may include head support rubber strands 146, head support hinge holes 148, and head support flange screw holes 150. Head support rubber strands 146 may be a plurality of strips of rubber that may provide a non-slip or slip resistant surface to help retain a toddler on top of recliner 100. Head support rubber strands 146 may be attached widthwise to head support frame 136 inside head support interior 145. Head support rubber strands 146 may be space remotely apart from each other and be positioned underneath head support strand opening 142 to cover head support strand opening 142 from underneath.

Head support hinge holes 148 may be openings through head support frame 138 to receive hinge screws 152. Flange screw holes 150 may be openings through head support frame 138 to receive flange screws 154.

Torso support 104 may be a structure to bear the weight of a toddler's torso, such as from the toddler's seventh cervical vertebra to the maximum posterior protrusion of the toddler's buttock. Torso support 104 generally may have a rectangular shape and may include a torso support frame 156, a torso support strand opening 158, a torso support core first opening 160, a torso support core second opening 162, and a torso support interior 164. Torso support frame 156 may be hollow to define torso support interior 164. Torso support strand opening 158, torso support core first opening 160, and torso support core second opening 162 may be passageways through torso support frame 156 into torso support interior 164. Torso support core first opening 160 and torso support core second opening 162 may be on opposite sides of torso support frame 156 and be large enough to receive bubble foam core 108 into torso support core first opening 160 and out of torso support core second opening 162.

Torso support 104 additionally may include torso support rubber strands 166, torso support hinge holes 168, head support dial mechanism hole 170, head support dial mechanism ramp 172, footrest dial mechanism hole 174, head support dial mechanism ramp 176, a left rib 178, a right rib 180, a torso support first leg 182, and a torso support second leg 184.

Torso support rubber strands 166 may be a plurality of strips of rubber that may provide a non-slip or slip resistant surface to help retain a toddler on top of recliner 100. Torso support rubber strands 166 may be attached widthwise to torso support frame 156 inside torso support interior 164. Torso support rubber strands 166 may be space remotely apart from each other and be positioned underneath torso support strand opening 158 to cover torso support strand opening 158 from underneath.

Torso support hinge holes 168 may be openings through torso support frame 158 to receive hinge screws 152 and attach hinge 110 to torso support frame 156. Head support dial mechanism hole 170 and footrest dial mechanism hole 174 may be openings through torso support frame 158. Head support dial mechanism ramp 172 and head support dial mechanism ramp 176 each may be curved, inclined paths projecting out from torso support frame 158.

Left rib 178 and right rib 180 may be elongated rectangular projections attached within torso support interior 164 and extending away from torso support interior 164 towards each other. Left rib 178 and right rib 180 may help guide footrest 106 into and out of torso support 104. Torso support first leg 182 and torso support second leg 184 each may be one of the four supports for recliner 100 to elevate a reclining surface of recliner 100 above a bathtub and water in that bathtub. Torso support first leg 182 and torso support second leg 184 may be attached to torso support frame 156 below torso support hinge holes 168.

Footrest 106 may be a structure to rest the feet of a toddler reclining on recliner 100. Footrest 106 generally may have a rectangular shape and may include a footrest frame 186 having recliner front 118, a footrest strand opening 188, a footrest core opening 190, and a footrest interior 192. Footrest frame 186 may be hollow to define footrest interior 192. Footrest strand opening 188 and footrest core opening 190 may be passageways through footrest frame 186 into footrest interior 192. Recliner front 118 may enclose an end of footrest frame 186. Footrest core opening 190 may be on an opposite side of recliner front 118 and be large enough to receive bubble foam core 108 through footrest core opening 190.

Footrest 106 additionally may include footrest rubber strands 194, footrest adjustment holes 196, a left channel 198, and a right channel (not shown) on a side of footrest 106 opposite that of left channel 198. Footrest 106 further may include a footrest first leg 200 and a footrest second leg 202.

Footrest rubber strands 194 may be a plurality of strips of rubber that may provide a non-slip or slip resistant surface to help retain a toddler on top of recliner 100. Footrest rubber strands 194 may be attached widthwise to footrest frame 136 inside footrest interior 192. Footrest rubber strands 194 may be space remotely apart from each other and be positioned underneath footrest strand opening 188 to cover footrest strand opening 188 from underneath.

Footrest adjustment holes 196 may be openings through footrest frame 186 to aid in retaining footrest 106 and torso support 104 against one another. Left channel 198 may be a long, narrow groove to receive and guide left rib 178. Footrest first leg 200 and footrest second leg 202 each may be one of the four supports for recliner 100 to elevate a reclining surface of recliner 100 above a bathtub and water in that bathtub. Footrest first leg 200 and footrest second leg 202 may be attached to footrest frame 186 below recliner front 118.

Bubble foam core 108 may be a center part of recliner 100. Bubble foam core 108 may be a soft, washable, reusable, and replaceable part of recliner 100 to support and provide comfort to a toddler lying on recliner 100. In addition, bubble foam core 108 may help keep head support 102, torso support 104, and footrest 104 aligned. Bubble foam core 108 may have a bubble foam core length 203 that may be ninety percent of fully extended recliner overall length 126.

Bubble foam core 108 may be made of polystyrene, propylene, and other foam material. In one example, bubble foam core 108 may be buoyant so that recliner 100 may tend to float when place in water. This may help a person retrieve recliner 100 in a tub of water. In another example, bubble foam core 108 may be may be weighted so that recliner 100 may tend to sink when place in water. This may provide an initial stable platform on which a toddler may recline.

Bubble foam core 108 may have a support pad 204, a tilting area 206, and a footrest pad 208. Support pad 204 may have a support pad width 210 and footrest pad 208 may have a footrest pad width 212. Support pad 204 may taper down in width to meet with footrest pad 208 such that footrest pad width 212 may be smaller than support pad width 210. Tilting area 206 may be that portion of bubble foam core 108 located adjacent to the connection between head support 102 and torso support 104.

Support pad 204 may be positioned within head support 102 and torso support 104 and footrest pad 208 may be positioned within torso support 104 and footrest 106 in head support interior 145, torso support interior 164, and footrest interior 192. Support pad 204 may be moveable within head support interior 145, torso support interior 164, and footrest interior 192. To install or remove bubble foam core 108 from recliner 100, recliner 100 may be place in a fully closed position as in FIG. 4, bubble foam core 108 may be bent 180 degrees at tilting area 206, and bubble foam core 108 may be moved in a direction of arrow 214 (FIG. 4).

Hinge 110 may be a jointed or flexible device to permit head support 102 to turn relative to torso support 104. Hinge 110 may be attached between head support 102 and torso support 104.

Figure 6:
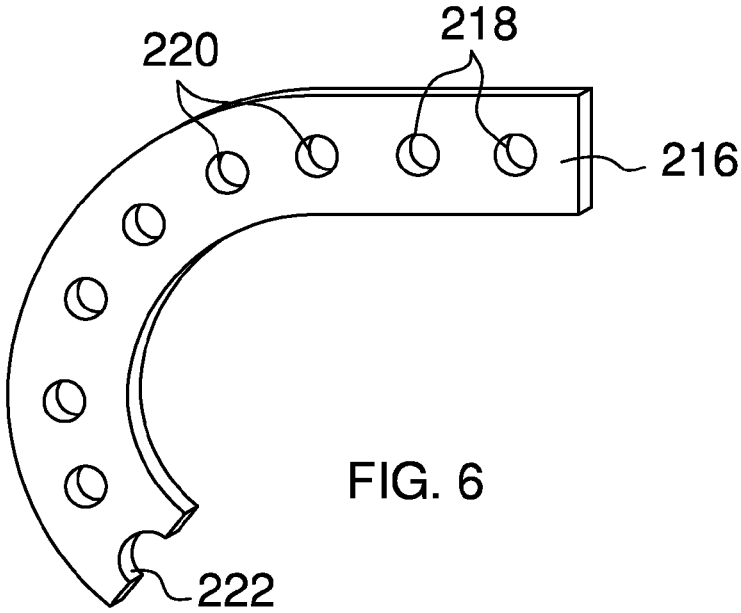
FIG. 6 is an enlarged, isometric view of flange 216.

To retain head support 102 at different angles relative to torso support 104, recline 100 may include a flange 216. FIG. 6 is an enlarged, isometric view of flange 216. Flange 216 may be a rigid, hooked shaped fitting in the shape of a C having flange screw holes 218, flange adjustment holes 220, and a flange concave notch 222. Flange concave notch 222 may be cutout through flange 216 in the shape of half a hole. Flange screw holes 218 and flange adjustment holes 220 may be openings through flange 216. Flange screw holes 218 may be placed within head support interior 145 and aligned with head support flange screw holes 150. Flange screws 154 may be inserted through both head support flange screw holes 150 and flange screw holes 218 to secure flange 216 to head support 102.

To retain head support 102 at different angles relative to torso support 104, recline 100 additionally may include a head support dial mechanism 300. To retain footrest 106 at different distances relative to torso support 104, recliner 100 may include a footrest dial mechanism 400. Head support dial mechanism 300 and footrest dial mechanism 400 may have similar construction and function.

Figure 7:
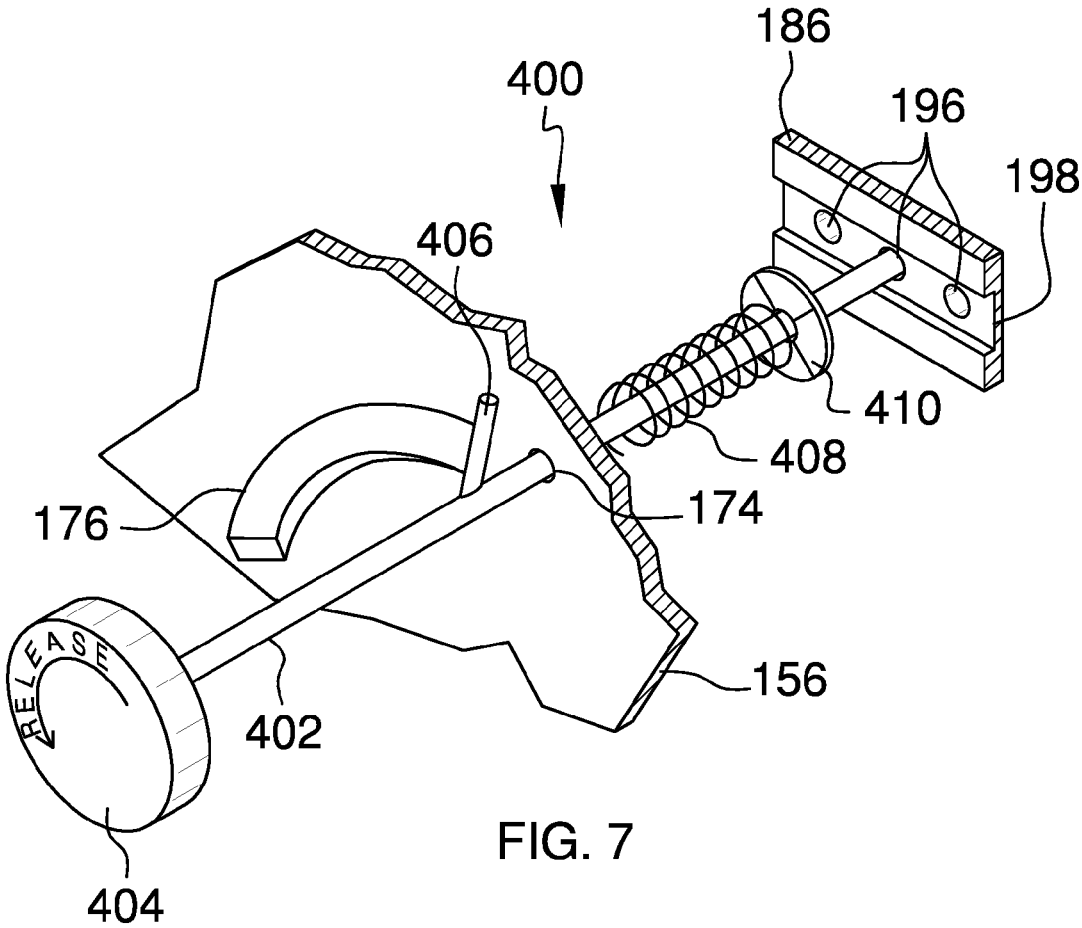
FIG. 7 is an enlarged, detail view of footrest dial mechanism 400 generally taken off line 7 of FIG. 4.

FIG. 7 is an enlarged, detail view of footrest dial mechanism 400 generally taken off line 7 of FIG. 4. Footrest dial mechanism 400 may include a rod 402, a knob 404, a boss 406, a spring 408, and a retaining fastener 410. Rod 402 may be connected to knob 404. Boss 406 may be attached to rod 402 and extend radially outward. Rod 402 may be inserted through footrest dial mechanism hole 174, spring 408, and retaining fastener 410 in that order.

Rod 402 may be a round, rigid cylinder. Knob 404 may be a handle. Boss 406 may be a round, rigid cylinder configured to slide along head support dial mechanism ramp 176. Spring 408 may be an elastic device that returns to its shape or position when pushed, pulled, or pressed. Retaining fastener 410 may be a push on retaining fastener having four teeth angled towards each other to grab rod 402 after being pressed onto rod 402. In operation, knob 404 may be rotated to rotate boss 406 along the curved, inclined path of head support dial mechanism ramp 176. This works to move retaining fastener 410 towards torso support frame 156 to compress spring 408. In addition, this works to move rod 402 out of footrest adjustment holes 196 to free footrest 106 to slide in and out of torso support 104.

The recliner may be an accessory for the bathtub that may provide support when bathing a toddler and washing his or her hair. The recliner may provide support for a child to lean back so their hair may be wetted, shampooed, and rinsed without getting water or soap in their face or eyes.

The recliner may be a rectangular plastic chair with curved rims/edges and a back support that may adjust to different angles. The recliner may be sized to fit in a typical bathtub and may measure overall approximately 2 feet 8 inches long, 1 foot wide, and 8 inches high. The two sections forming the base of the recliner may be slide together for storage. A dial lock mechanism on the side may be release the sections to allow the two sections forming the base of the recliner to slide together or apart. The 8-inch long backrest may have a locking dial to allow it to release and recline and to lock in the chosen position. The chair may be covered with a foam padding material for comfort and slip resistance.

The toddler hair wash recliner chair may include a lock reliever dial midway of the chair that may allow the chair to adjust inward or outward. The recliner may have a second reliever dial that may allow the recliner to recline and lock in a desired position. When the first dial is in the unlocked position, the back half of the recliner may allow the chair to tuck all the way in. The dial on the reclining part of the recliner may allow the top part of the chair to fold all the way over into the mid section when the second reliever dial is unlocked.

The recliner may fulfill a need for a bathtub support for toddlers that may be used when their hair is being washed. Appealing features of the recliner include its convenient design, ease of use, and practicality. The recliner may accommodate kids from ten months to five years and more of age. The recliner may provide support for the child's back, neck, and head during the shampooing process. The support provided by the recliner may allow the toddler to relax and alleviating fears of slipping under the water. The recliner may allow the child to lie back while having his/her hair washed. In addition, because the parent may be no longer need to support the child manually, both hands may be free to wash and rinse the hair. Because the child's head may be positioned to allow the water to flow back away from the face of the child, the child will not feel a need to shield their eyes and face from lather and water, and parents may not feel a need to do this for them. The recliner may make the toddler hair washing process easier and less traumatic for both the parent and the child. A result of using the recliner may be happier children who may have fun during the rest of his or her bath-time.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A bathtub hair wash recliner for a toddler in a bathtub, the bathtub hair wash recliner comprising:

a head support having a head support frame, where the head support frame includes a head support strand opening, a head support core opening, and a head support interior, where head support rubber strands are attached widthwise to the head support frame inside the head support interior to cover head support strand opening from underneath;

a torso support having a torso support frame, where the torso support frame includes a torso support strand opening and a torso support interior open at one end by a torso support core first opening and open at a second end by a torso support core second opening, where torso support rubber strands are attached to torso support frame;

a footrest having a footrest frame, where the footrest frame includes a footrest strand opening and a footrest interior closed at one end by a recliner front and open at a second end by a footrest core opening;

a bubble foam core positioned within the head support interior, the torso support interior, and the footrest interior, where the bubble foam core includes a tilting area, a support pad having a support pad width, and a foot rest pad having a footrest pad width, where the support pad width is greater than the footpad width, and where when the head support is lying on the torso support, the bubble foam core is removable from the recliner by pulling on the tilting area in a direction that is parallel to the head support and the torso support;

a hinge attached between the head support and the torso support;

a flange attached to the head support interior, where the flange is curved and includes flange adjustment holes along the curve; and a head support dial mechanism having a rod attached to a dial positioned outside of the torso support, where the rod is positioned through the torso support and includes a spring positioned in the torso support and held around the rod by a fastener, where the rod is configured to pass through one of the flange adjustment holes.

2. The bathtub hair wash recliner of claim 1, where when the head support is lying against the torso support and the footrest in fully inserted into the torso support, the recliner fits within a one and one-half foot length by one foot width by one-foot high volume.

3. The bathtub hair wash recliner of claim 2, where when the footrest is extended from the torso support to a maximum distance, the distance between the hinge and the recliner front identifies a cervicale length, where the cervicale length is 110% of the cervicale height of a toddler in the 95th percentile.

4. The bathtub hair wash recliner of claim 3, where the bubble foam core has a bubble foam core length that is ninety percent of a fully extended recliner overall length of the recliner.

5. The bathtub hair wash recliner of claim 1, where the bubble foam core includes at least one of polystyrene and propylene.

6. The bathtub hair wash recliner of claim 1, where the torso support rubber strands are attached to torso support frame to close torso support strand opening, where the torso support additionally includes a left rib, a right rib, a torso support first leg, and a torso support second leg, where the left rib and right rib are elongated rectangular projections attached within torso support interior to extend away from torso support interior towards each other, and where the torso support first leg and the torso support second leg are attached to the torso support frame below the hinge.

7. The bathtub hair wash recliner of claim 6, where footrest rubber strands are attached to torso support frame to close the torso support strand opening, where the footrest further includes a left channel, a footrest first leg, and a footrest second leg, where the left channel is a long, narrow groove to receive and guide the left rib, where the footrest first leg and footrest second leg are attached to the footrest frame below the recliner front.

8. A bathtub hair wash recliner for a toddler in a bathtub, the bathtub hair wash recliner comprising:

a head support having a head support frame, where the head support frame includes a head support strand opening, a head support core opening, and a head support interior, where head support rubber strands are attached widthwise to the head support frame inside the head support interior to cover head support strand opening from underneath;

a torso support having a torso support frame, where the torso support frame includes a torso support strand opening and a torso support interior open at one end by a torso support core first opening and open at a second end by a torso support core second opening, where torso support rubber strands are attached to torso support frame;

a footrest having a footrest frame, where the footrest frame includes a footrest strand opening and a footrest interior closed at one end by a recliner front and open at a second end by a footrest core opening, where footrest rubber strands are attached to torso support frame to close the torso support strand opening, where the footrest further includes a left channel, a footrest first leg, and a footrest second leg, where the left channel is a long, narrow groove to receive and guide the left rib, where the footrest first leg and footrest second leg are attached to the footrest frame below the recliner front;

a bubble foam core positioned within the head support interior, the torso support interior, and the footrest interior, where the bubble foam core includes a tilting area, a support pad having a support pad width, and a foot rest pad having a footrest pad width, where the support pad width is greater than the footpad width, and where when the head support is lying on the torso support, the bubble foam core is removable from the recliner by pulling on the tilting area in a direction that is parallel to the head support and the torso support;

a hinge attached between the head support and the torso support;

a flange attached to the head support interior, where the flange is curved and includes flange adjustment holes along the curve; and a head support dial mechanism having a rod attached to a dial positioned outside of the torso support, where the rod is positioned through the torso support and includes a spring positioned in the torso support and held around the rod by a fastener, where the rod is configured to pass through one of the flange adjustment holes.

9. The bathtub hair wash recliner of claim 8, where when the head support is lying against the torso support and the footrest in fully inserted into the torso support, the recliner fits within a one and one-half foot length by one foot width by one-foot high volume.

10. The bathtub hair wash recliner of claim 9, where when the footrest is extended from the torso support to a maximum distance, the distance between the hinge and the recliner front identifies a cervicale length, where the cervicale length is 110% of the cervicale height of a toddler in the 95th percentile.

11. The bathtub hair wash recliner of claim 10, where the bubble foam core has a bubble foam core length that is ninety percent of a fully extended recliner overall length of the recliner.

12. The bathtub hair wash recliner of claim 8, where the bubble foam core includes at least one of polystyrene and propylene.

13. The bathtub hair wash recliner of claim 8, where torso support rubber strands are attached to torso support frame to close torso support strand opening, where the torso support additionally includes a left rib, a right rib, a torso support first leg, and a torso support second leg, where the left rib and right rib are elongated rectangular projections attached within torso support interior to extend away from torso support interior towards each other, and where the torso support first leg and the torso support second leg are attached to the torso support frame below the hinge.

* * * * *